United States Patent [19]

Burg et al.

[11] 4,117,604

[45] Oct. 3, 1978

[54] DRYER FOR PHOTOGRAPHIC PROCESSORS

[75] Inventors: John S. Burg, Crystal; Donald M. Davidson, New Hope; Marvin K. McClure, Minneapolis; Benjamin H. Sannel, St. Louis Pk., all of Minn.

[73] Assignee: Pako Corporation, Minneapolis, Minn.

[21] Appl. No.: 783,174

[22] Filed: Mar. 31, 1977

[51] Int. Cl.[2] ..... F26B 19/00

[52] U.S. Cl. ..... 34/70; 34/95; 34/240; 118/104; 118/117

[58] Field of Search ..... 34/70, 71, 95, 239, 34/240; 100/120, 121; 118/115, 116, 117, 104

[56] References Cited

U.S. PATENT DOCUMENTS

| | | | |
|---|---|---|---|
| 2,236,430 | 3/1941 | Hurxthal | 34/70 |
| 2,348,698 | 5/1944 | Thompson | 118/117 X |
| 2,448,854 | 9/1948 | Beguin | 34/70 X |
| 2,574,833 | 11/1951 | Kuljian | 34/70 |
| 3,689,147 | 9/1972 | Suzuki | 34/70 X |
| 3,934,354 | 1/1976 | Hope | 34/95 X |
| 3,968,571 | 7/1976 | Oschatz | 34/240 X |

*Primary Examiner*—Harold Weakley

*Attorney, Agent, or Firm*—John W. Adams; David R. Fairbairn

[57] ABSTRACT

A compact inexpensive dryer unit for photographic processors which includes a liquid removing squeegee unit, transport rollers and guiding means for moving photographic sheet material through the drying area, a pair of opposed tapered air distribution manifolds to uniformly distribute warm drying air against both sides of the sheet material in close proximity thereto as it travels through the dryer with provision for recirculating substantial portions of the warmed air after it travels through the drying area of the unit, one of said manifolds being hinged to facilitate access to said drying area for servicing.

6 Claims, 8 Drawing Figures

DRYER FOR PHOTOGRAPHIC PROCESSORS

Most photographic dryers in the past have been large, cumbersome units with many transport rollers and frequently embodying a relatively long festoon-like drying path which are expensive to manufacture and which produce control problems with the material being dried as it passes through the drying path.

It is an object of the present invention to provide a dryer for photographic materials which embodies a compact relatively short drying path through which the sheet material being dried is easily transported and which is designed to maintain constant control over the sheet material during the entire drying operation.

It is another object to provide an extremely compact dryer unit which directs the warm air through confined discharge manifold units which uniformly distribute the flow of said air simultaneously against both sides of the strip being dried and which has a hinged top cover section which provides quick access to the drying area for servicing in the event of problems.

It is another object to provide a compact highly efficient drying unit for photographic material which incorporates a highly efficient squeegee unit for initially removing substantially all of the liquid from the surfaces of the sheet material prior to introduction into the drying area.

These and other objects of the invention will more fully appear from the following description made in connection with the drawings in which.

Figure 1:
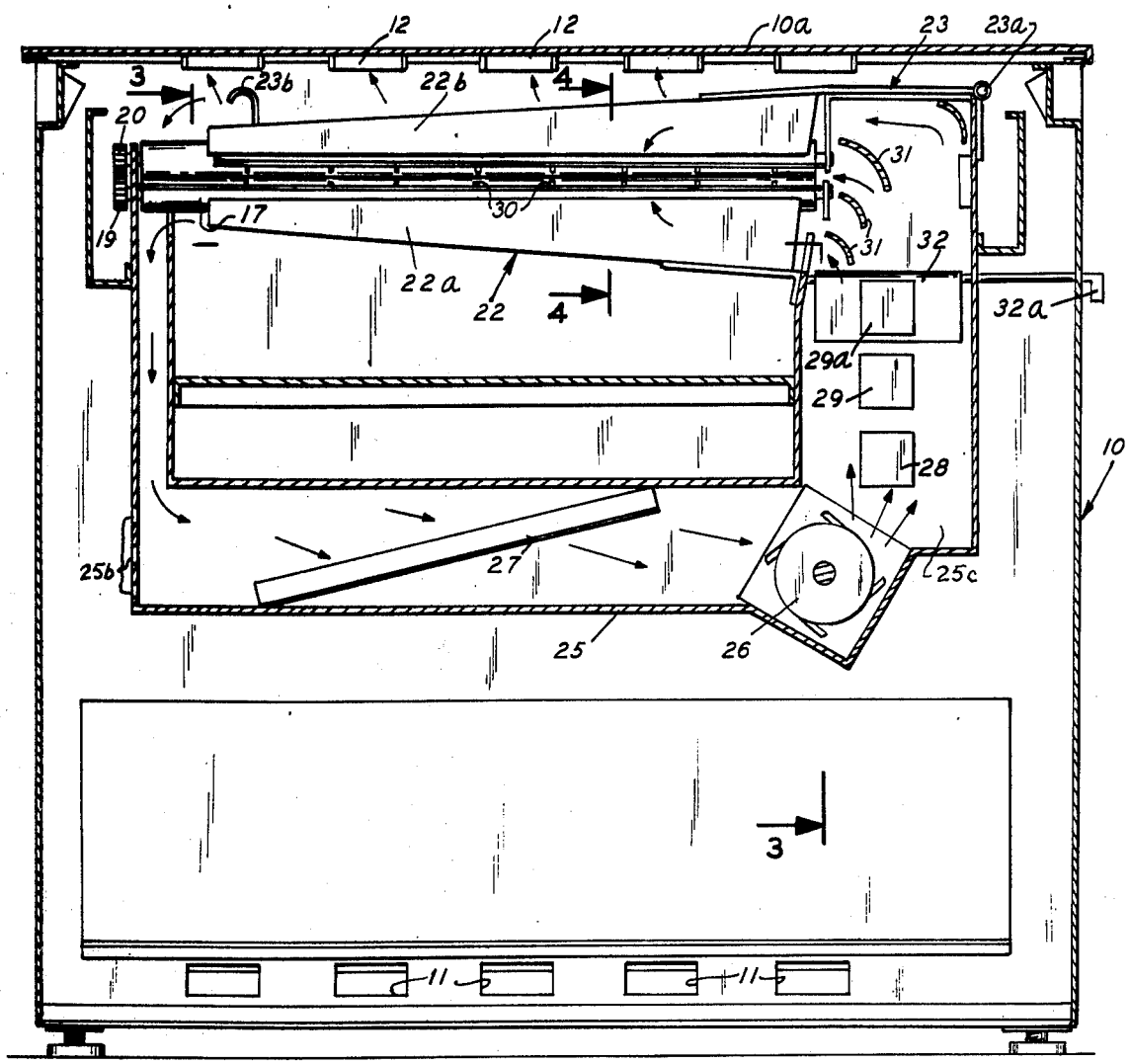
FIG. 1 is a vertical sectional view taken through the dryer unit transversely of the path of the photographic material being dried.

Referring to the drawings, the drying device illustrated has an outer cabinet designated as an entirety by the numeral 10 with a removable top 10*a*. Suitable air inlet holes 11 are provided in the bottom of cabinet 10 and suitable outlet openings 12 are provided in top 10*a*. The strip of photographic material is designated by the numeral 13 and enters the dryer from the processor tanks designated as an entirety by the numeral 14 through a material receiving opening 10*b* in the cabinet 10.

Figure 3:
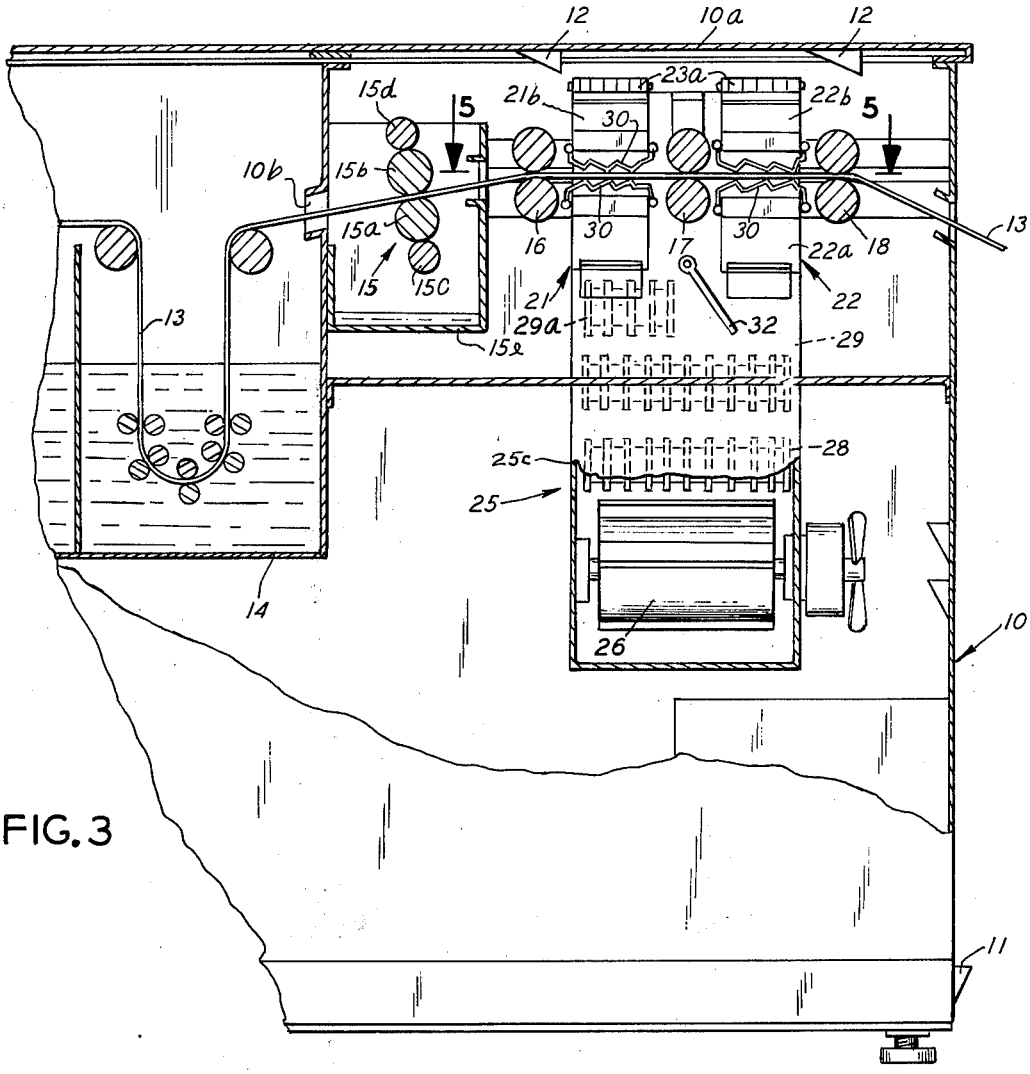
FIG. 3 is a vertical sectional view taken substantially along the broken line 3—3 of FIG 1.
Figure 4:
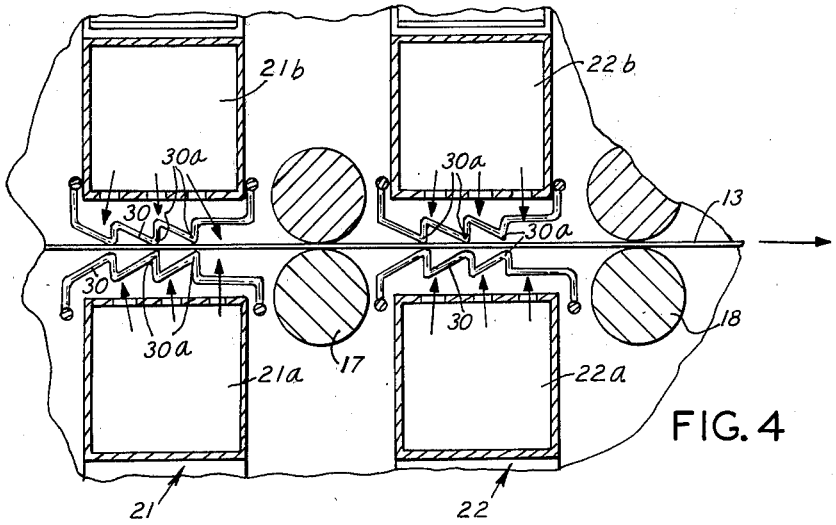
FIG. 4 is a vertical fragmentary view taken substantially along the line 4—4 of FIG. 1.

The squeegee roller assembly designated as an entirety by the numeral 15 includes a pair of squeegee rollers 15*a* and 15*b* and a pair of wiper rollers 15*c* and 15*d* as best shown in FIG. 3. In the form shown three pairs of transfer rollers respectively designated as 16, 17 and 18 are provided. The lower roller is driven by any suitable means (not shown) which drives the lower driving gears 19 of each of the pairs of transport rollers 16, 17 and 18 respectively, and the upper roller in each pair has a pinion gear 20 connected therewith for driving the same when meshed with the lower driving gear 19.

Figure 2:
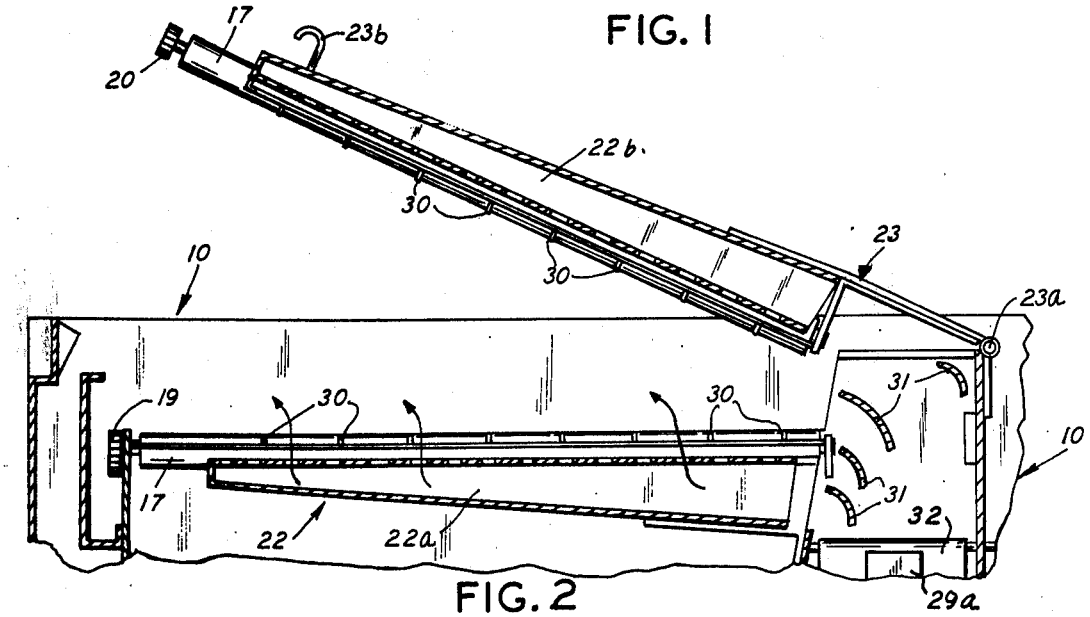
FIG. 2 is a similar view showing the hinged top section of the drying unit in raised position to provide access to the drying area of the device.
Figure 5:
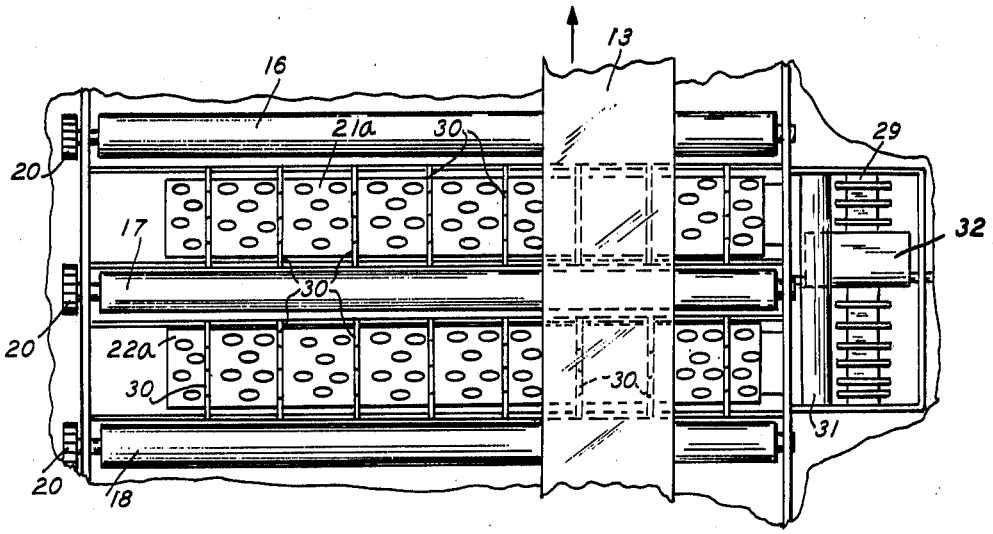
FIG. 5 is a fragmentary horizontal sectional view taken substantially along the line 5—5 of FIG. 3.

In the form of the invention shown, two pairs of opposed tapered air distributing manifolds 21 and 22 are provided. Each pair 21 and 22 respectively comprises an upper and lower manifold 21*b* and 21*a* and 22*b* and 22*a* positioned in generally opposed parallel spaced relation. The lower manifolds 21*a* and 22*a* of each pair are mounted in the lower stationary portion, or base, of the device and the upper manifolds 21*b* and 22*b* are mounted in the upper hinged portion of the device. The hinged top portion is best shown in FIGS. 1 and 2 and is designated by the numeral 23 and is connected to inner housing 25 by the hinges 23*a* extending across one side thereof. A lifting hook 23*b* is provided for raising the top 23 into the position shown in FIG. 2. Each of the manifolds 21*a*, 21*b*, 22*a* and 22*b* is provided with a plurality of air discharge openings in the opposed positions thereof, said openings positioned in a staggered arrangement which is best shown in FIG. 5.

A circulation chamber is defined by an inner housing 25, the top of which is formed by the hinged section 23. A blower 26 draws air through a filter 27 from the upper portion of the chamber and from outside housing 25 through air intake openings 25*b* positioned ahead of filter 27 and directs said air over a pair of heating coils 28 and 29 which extend across an air passageway 25*c* inside housing 25 as best shown in FIGS. 1 and 2. Air deflection elements such as a plurality of stationary air deflecting vanes 30 extend across the upper portion of the housing 25 as best shown in FIG. 1 to direct the hot air from the heating coils 28 and 29 into the air intakes at the large ends of the two pairs of manifolds 21 and 22. Sheet guiding means are provided to stabilize the photographic sheet material traveling between the manifold pairs 21 and 22 and in the form shown comprise a plurality of wire-like guiding elements 30 respectively clipped onto the opposed perforated portions of the manifolds 21*a* and 21*b* and 22*a* and 22*b*, as best shown in FIG. 3. Each of these guiding elements 30 is bent to provide a plurality of spaced apart contact points 30*a*. This is designed to limit the area of contact between the elements 30 and the sheet material being processed. When the air is discharged from the manifold pairs 21 and 22 some of it is recirculated down into the bottom of housing 25 and through the filter 27 and blower 26. A portion is, of course, discharged around the strip of material and between the upper manifolds 21*b* and 22*b* and is free to pass out through the louvered openings 12 and the top cover 10*a* and additional air is able to move into the cabinet 10 through the lower openings 11 previously described.

Figure 7:
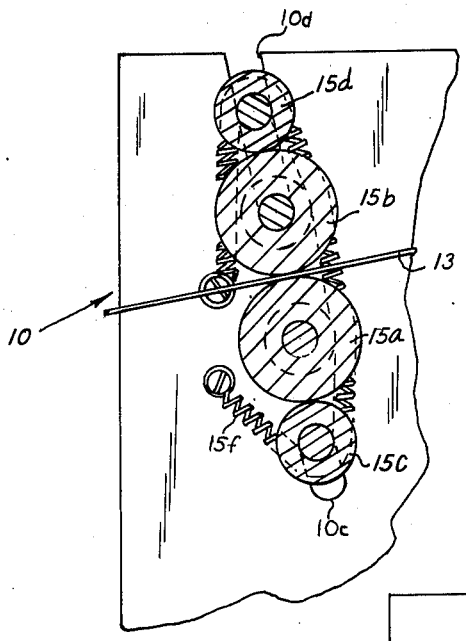
FIG. 7 is a vertical sectional view thereof.
Figure 6:
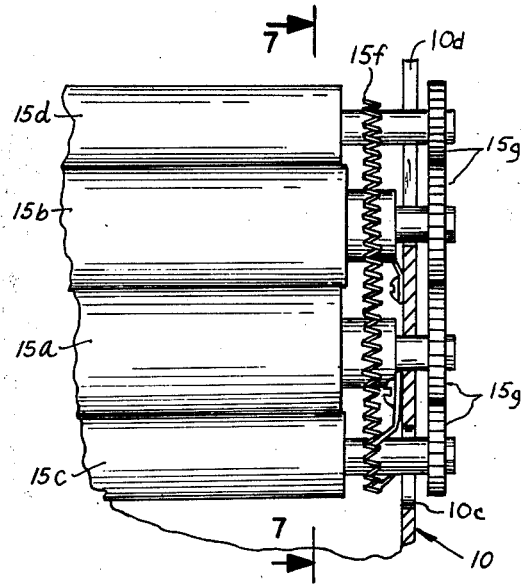
FIG. 6 is a fragmentary elevational view showing the squeegee roller assembly.
Figure 8:
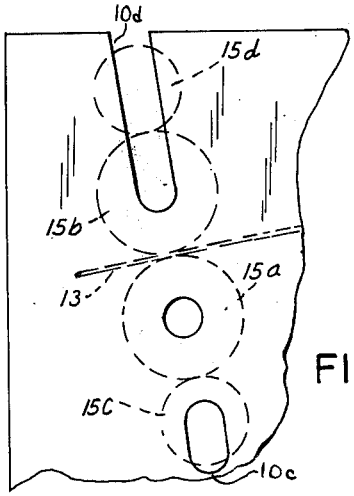
FIG. 8 is a fragmentary diagrammatical view showing the relationship of the rollers and the mounting plates therefor at the end opposite to the driven end shown in FIGS. 6 and 7.

As shown in FIGS. 6–8, roller 15*a* is journaled in cabinet 10 while the ends of rollers 15*b* and 15*d* extend through slots 10*d* of cabinet 10 and the ends of roller 15*c* extend through slots 10*c*. Gears 15*g* are respectively attached to an end of each roller 15*a*, 15*b*, 15*c* and 15*d*, said gears being meshed with each other as best shown in FIG. 6. A spring 15*f* is stretched around rollers 15*a*, 15*b*, 15*c* and 15*d* and resiliently positions rollers 15*b* and 15*c* in contact with roller 15*a*, and also resiliently holds roller 15*d* in contact with roller 15*b*. As the strip of material 13 passes through the opening 10*b* it passes between the squeegee rollers 15*a* and 15*b* which are made of a soft, compressible liquid absorbing material, slightly compressing said squeegee rollers to ensure proper liquid-removing contact between strip 13 and rollers 15*a* and 15*b*. Roller 15*d* has a liquid-absorbing surface material such as phenolic impregnated paper, while roller 15*c* is made from a liquid repellant material such as stainless steel. Roller 15*d* spreads out the liquid absorbed by roller 15*b* to facilitate transfer of said liquid from roller 15*b* to roller 15*a* at the points of contact between the two rollers. Since roller 15*a* is ordinarily drier than roller 15*b*, roller 15*a* absorbs some of the liquid contained in roller 15*b*, thus keeping roller 15*b* somewhat dry. The liquid thus absorbed by roller 15*a* is squeezed out by roller 15*c* and drips off said roller 15*c* into a suitably positioned drip pan 15.

Said strip 13 is then transported between the manifold pairs 21 and 22 by the three sets of transfer rollers 16, 17 and 18. The guiding elements 30 stabilize the strip 13 while drying air is directed onto said strip. The dried strip 13 is then discharged through opening 10*c* of cabinet 10. The upper, hinged manifolds 21*b* and 22*b* can be easily raised to provide access to the bottom manifolds 21*a* and 21*b* and strip 13, as shown in FIG. 2.

It will of course be understood that various changes may be made in the form, details, arrangement and proportions of the parts without departing from the scope of this invention, which generally stated, is set forth in the appended claims.

What is claimed is:

1. A compact dryer unit for drying photographic sheet material being processed, said drying unit comprising:

a housing having a material receiving opening and a material discharge opening and defining a drying chamber having vents for intake and exhaust air therein, a pair of liquid spreading and removing rollers adjacent the material receiving opening and engaging the surfaces of the photographic sheet to remove and uniformly spread the liquid on the photographic surface of the sheet, a plurality of rollers and sheet guiding means constructed and arranged to define a transport path extending in substantially straight line relation between the receiving opening and the discharge opening, at least one pair of opposed spaced apart hollow air distribution manifolds in said drying chamber and respectively mounted on opposite sides of said transport path and having opposed portions said manifolds having air intakes disposed at the same side of the drying chamber and including a plurality of spaced air discharge openings formed in said opposed portions and arranged in such a way to discharge in substantially uniform quantities and velocities drying air against the surface areas on both sides of the sheet material being transported along said transport path from said material receiving opening to said material discharge opening, a single blower remote from said manifold for supplying drying air to said drying chamber and the air intakes of said manifolds, and means for heating the drying air.

2. The structure set forth in claim 1 and said pair of liquid spreading and removing rollers comprising compressible squeegee rollers a pair of pressure applying liquid removing rollers respectively engaged with the squeegee rollers with the axes thereof of all of said rollers lying substantially in the same plane and resilient means for maintaining contact between adjacent rollers.

3. The structure set forth in claim 1 and one manifold of each of said pairs of manifolds being pivotally mounted to provide easy access to the portions of said transport path between said pair of manifolds.

4. The structure set forth in claim 1 and a plurality of air deflecting vanes extending in the flow path of the air substantially adjacent the intake openings of the manifolds to uniformly distribute the air from said blower to the respective manifolds.

5. A compact dryer unit for drying photographic sheet material being processed, said drying unit comprising:

a housing having a material receiving opening and a material discharge opening and defining a drying chamber therein, a plurality of rollers and sheet guiding means constructed and arranged to define a transport path extending in substantially straight line relation between the receiving opening and the discharge opening, at least one pair of opposed spaced apart hollow air distribution manifolds respectively mounted on opposite sides of said transport path and having opposed portions, each manifold having an air intake and including a plurality of spaced air discharge openings formed in said opposed portions and arranged in such a way to discharge in substantially uniform quantities and velocities drying air against the surface areas on both sides of the sheet material being transported along said transport path from said receiving opening to said discharge opening, means for supplying heated drying air to the air intakes of said manifolds, and sheet guiding means in the form of a plurality of transversely spaced wire-like elements arranged generally longitudinally of the transport path and removably mounted in the respective manifolds to permit the drying air to pass therethrough while maintaining the transport sheets in predetermined spaced relation to the discharge openings of said manifolds.

6. The structure set forth in claim 5 wherein said wire-like elements having zigzag bends formed therein to produce a plurality of spaced apart contact projections to minimize the area of contact between said elements and the sheet material being processed.

* * * * *